US010280944B2

(12) United States Patent
Arenella et al.

(10) Patent No.: US 10,280,944 B2
(45) Date of Patent: May 7, 2019

(54) SAFETY COMPLIANT FAN FINGER GUARD INTEGRATED WITH ANTI-RECIRCULATION STRUCTURE AND METHOD

(71) Applicant: International Business Machines Corporation, Armonk, NY (US)

(72) Inventors: Kenneth Arenella, Wappingers Falls, NY (US); Levi A. Campbell, Poughkeepsie, NY (US); Christopher R. Ciraulo, Wappingers Falls, NY (US); Robert K. Mullady, Highland, NY (US); Budy D. Notohardjono, Poughkeepsie, NY (US); Arkadiy O. Tsfasman, Wappingers Falls, NY (US); John S. Werner, Putnam Valley, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 133 days.

(21) Appl. No.: 15/611,883

(22) Filed: Jun. 2, 2017

(65) Prior Publication Data

US 2018/0347592 A1 Dec. 6, 2018

(51) Int. Cl.
*F04D 29/66* (2006.01)
*F04D 29/70* (2006.01)
*F04D 29/56* (2006.01)

(52) U.S. Cl.
CPC ..... *F04D 29/703* (2013.01); *F04D 29/563* (2013.01)

(58) Field of Classification Search
CPC .. F04D 5/007; F04D 15/0022; F04D 29/4293; F04D 29/70; F04D 29/703; F04D 29/56; F04D 29/563
(Continued)

(56) References Cited

U.S. PATENT DOCUMENTS 4,120,615 A * 10/1978 Keem ..... F04D 29/526 220/324
5,460,571 A 10/1995 Kato et al.
(Continued)

FOREIGN PATENT DOCUMENTS

EP 0 611 924 A1 8/1994
JP 1-314834 12/1989
(Continued)

OTHER PUBLICATIONS

List of IBM Patents or Patent Applications Treated as Related dated Jun. 2, 2017, 2 pages.
(Continued)

*Primary Examiner* — Marguerite McMahon
(74) *Attorney, Agent, or Firm* — Scully, Scott, Murphy & Presser, P.C.; Tihon Poltavets

(57) ABSTRACT

A fan guard and method of use thereof. The fan guard includes a guard housing, the guard housing including a housing opening, one or more lattices, wherein the one or more lattices are pivotably connected to a portion of the guard housing, a linkage arm, wherein the one or more lattices are operably connected to the linkage arm, and a wedge portion operably connected to the linkage arm, wherein the wedge portion comprises a wedge portion face, and wherein the linkage arm is configured to move along a length of the guard housing and the linkage arm is configured to pivot the one or more lattices from a first position to a second position.

15 Claims, 14 Drawing Sheets

(58) Field of Classification Search
USPC ..... 415/121.2
See application file for complete search history.

(56) References Cited

U.S. PATENT DOCUMENTS

| | | | | |
|---|---|---|---|---|
| 6,042,348 | A | 3/2000 | Aakalu et al. | |
| 6,406,257 | B1 | 6/2002 | Houdek | |
| 6,503,060 | B1 | 1/2003 | Kamada et al. | |
| 6,775,137 | B2 | 8/2004 | Chu et al. | |
| 7,118,333 | B2 | 10/2006 | Takemoto | |
| 7,667,966 | B2 | 2/2010 | Ong et al. | |
| 8,066,559 | B2 | 11/2011 | Cochrane | |
| 8,093,851 | B2 | 1/2012 | Yang et al. | |
| 8,388,423 | B2 | 3/2013 | Cruz et al. | |
| 8,936,443 | B2 | 1/2015 | Mashak et al. | |
| 9,137,930 | B2 | 9/2015 | Alshinnawi et al. | |
| 9,157,536 | B2 * | 10/2015 | Li | F16K 15/035 |
| 9,383,117 | B2 | 7/2016 | Labrecque | |
| 2004/0197189 | A1 | 10/2004 | Seo et al. | |
| 2005/0095121 | A1 | 5/2005 | Vithani | |
| 2005/0168942 | A1 | 8/2005 | Steinbrecher et al. | |
| 2010/0244759 | A1 | 9/2010 | Makley et al. | |
| 2014/0187139 | A1 * | 7/2014 | Zhong | F24F 13/14 454/207 |
| 2015/0192219 | A1 | 7/2015 | Anderl et al. | |
| 2016/0095260 | A1 | 3/2016 | Campbell et al. | |
| 2016/0105996 | A1 | 4/2016 | Schanzenbach et al. | |
| 2016/0146223 | A1 * | 5/2016 | Cao | H05K 7/20172 415/1 |
| 2016/0356172 | A1 * | 12/2016 | DiVincenzo | F01D 17/02 |
| 2018/0347594 | A1 * | 12/2018 | Arenella | F04D 19/002 |

FOREIGN PATENT DOCUMENTS

| | | |
|---|---|---|
| JP | 4-203724 | 7/1992 |
| JP | 7-122870 | 5/1995 |
| JP | 7-324787 | 12/1995 |
| JP | 8-162790 | 6/1996 |
| WO | 03/042544 A1 | 5/2003 |
| WO | 2010/048730 A2 | 5/2010 |

OTHER PUBLICATIONS

Disclosed Anonymously, "Fan Guard Waiver", IPCOM000232276D, (3 pages) (Oct. 30, 2013).

Disclosed Anonymously, "Methods and Apparatus for Optimum Fan Operation While Maintaining High Safety Requirements", IPCOM000229498D, (5 pages) (Aug. 1, 2013).

U.S. Notice of Allowance dated Jan. 23, 2019 received in related U.S. Appl. No. 15/611,921.

* cited by examiner

SAFETY COMPLIANT FAN FINGER GUARD INTEGRATED WITH ANTI-RECIRCULATION STRUCTURE AND METHOD

BACKGROUND

The present application relates to guard structures, and more particularly to a guard structure that complies with safety features and guards a fan.

Fans are used in conjunction with various electrical equipment that benefit from the movement of heat and/or air from their location. The structure enclosing the fan and preventing injury to the user can contain a perforated metal or plastic structure. Perforations are holes in the structure which allow air flow through the structure. Said perforations to cover the fan may also prevent a person from having their clothing or a portion of their bodies contact the blades of the fan, are a safety requirement. The specified dimensions for the size of perforations or openings are found in safety standards, such as International Electrotechnical Commission (IEC) 60950.

These safety standards include size of opening requirements for fan enclosures, which cover one or more surfaces of a fan.

During operation, fan enclosures with larger openings increase airflow and increase the ability of the fan to disperse heat because less material is blocking air flow from the fan. But, there is a limit as to how large the openings can be so as to still satisfy the safety requirements.

Thus, a guard structure for a fan that is safety compliant and also allows for increased air flow when the fan is in use is desired.

SUMMARY

In one embodiment, a fan guard is provided. The fan guard includes a guard housing, the guard housing including a housing opening, one or more lattices, wherein the one or more lattices are pivotably connected to a portion of the guard housing, a linkage arm, wherein the one or more lattices are operably connected to the linkage arm, and a wedge portion operably connected to the linkage arm, wherein the wedge portion comprises a wedge portion face, and wherein the linkage arm is configured to move along a length of the guard housing and the linkage arm is configured to pivot the one or more lattices from a first position to a second position.

In another aspect of the present application a method of operating a fan guard is included. The method includes the steps of moving a bezel, wherein the bezel comprises a bezel protrusion and a bezel protrusion face in a first direction towards a guard housing, the guard housing including a housing opening, one or more lattices, wherein the one or more lattices are pivotably connected to a portion of the guard housing, a linkage arm, wherein the one or more lattices are operably connected to the linkage arm, a wedge portion operably connected to the linkage arm, wherein the wedge portion comprises a wedge portion face, and wherein the linkage arm is configured to move along a length of the guard housing and the linkage arm is configured to pivot the one or more lattices from a first position to a second position, wherein the bezel protrusion extends through the housing opening, contacting the wedge portion face with the bezel protrusion face, wherein the contact of the wedge portion face moves the linkage arm in a second direction, the second direction substantially perpendicular to the first direction and rotating the one or more lattices from a first position to a second position.

DETAILED DESCRIPTION

Figure 1:
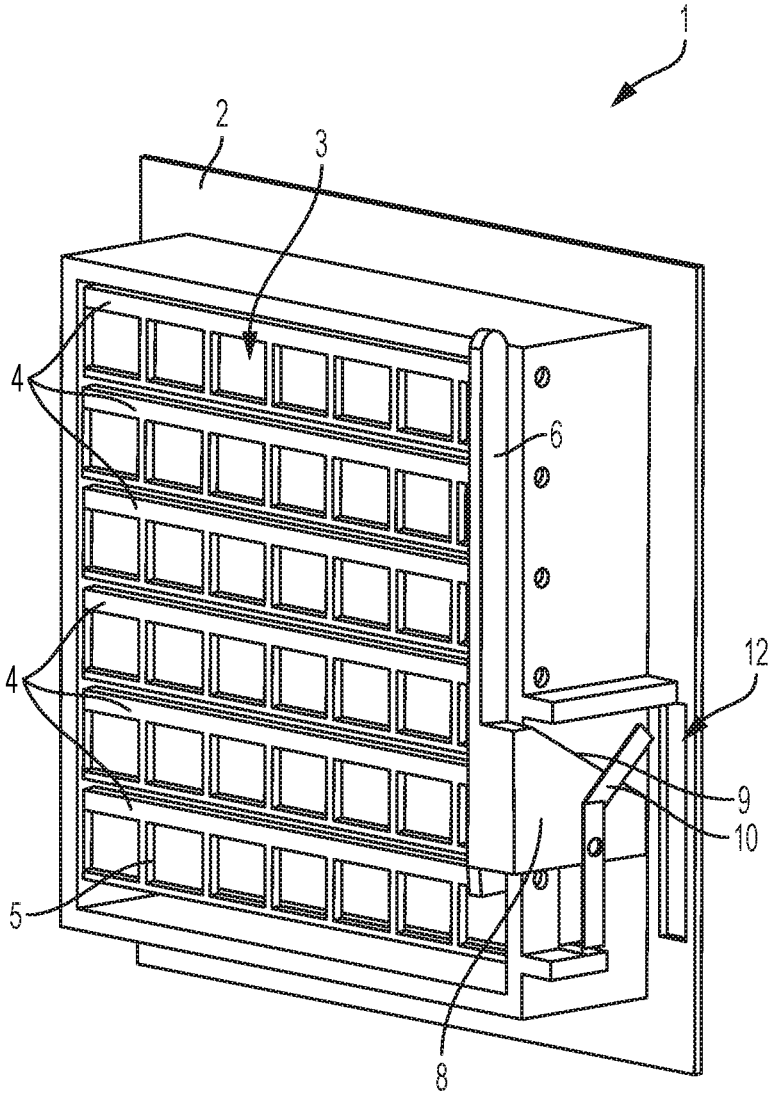
FIG. 1 is a perspective view of one embodiment of the application.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

In the following description, numerous specific details are set forth, such as particular structures, components, materials, dimensions, processing steps and techniques, in order to provide an understanding of the various embodiments of the present application. However, it will be appreciated by one of ordinary skill in the art that the various embodiments of the present application may be practiced without these specific details. In other instances, well-known structures or processing steps have not been described in detail in order to avoid obscuring the present application.

It will be understood that when an element as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "beneath" or "under" another element, it can be directly beneath or under the other element, or intervening elements may be present. In contrast, when an element is referred to as being "directly beneath" or "directly under" another element, there are no intervening elements present.

In the discussion and claims herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

As used herein, the term "substantially", or "substantial", is equally applicable when used in a negative connotation to refer to the complete or near complete lack of an action, characteristic, property, state, structure, item, or result. For example, a surface that is "substantially" flat would either be completely flat, or so nearly flat that the effect would be the same as if it were completely flat.

As used herein terms such as "a", "an" and "the" are not intended to refer to only a singular entity, but include the general class of which a specific example may be used for illustration.

As used herein, terms defined in the singular are intended to include those terms defined in the plural and vice versa.

Reference herein to any numerical range expressly includes each numerical value (including fractional numbers and whole numbers) encompassed by that range. To illustrate, reference herein to a range of "at least 50" or "at least about 50" includes whole numbers of 50, 51, 52, 53, 54, 55, 56, 57, 58, 59, 60, etc., and fractional numbers 50.1, 50.2 50.3, 50.4, 50.5, 50.6, 50.7, 50.8, 50.9, etc. In a further illustration, reference herein to a range of "less than 50" or "less than about 50" includes whole numbers 49, 48, 47, 46, 45, 44, 43, 42, 41, 40, etc., and fractional numbers 49.9, 49.8, 49.7, 49.6, 49.5, 49.4, 49.3, 49.2, 49.1, 49.0, etc. In yet another illustration, reference herein to a range of from "5 to 10" includes whole numbers of 5, 6, 7, 8, 9, and 10, and fractional numbers 5.1, 5.2, 5.3, 5.4, 5.5, 5.6, 5.7, 5.8, 5.9, etc.

As used herein the term "lattice" is used in a broad sense to refer to a mesh-like structure having one or more elements that extend across a frame to form a smaller opening, such as in a grate, a grid, a grill or a web of elements.

Referring first to FIG. 1, there is illustrated a general, front view of one embodiment of a fan guard 1. The fan guard 1 includes a guard housing 2, one or more lattices 4, a linkage arm 6, a wedge portion 8 operably connected to the linkage arm 6, a latch 10 and a housing opening 12.

Each of the one or more lattices 4 is pivotably connected on each end to a portion of the guard housing 2. Each of the one or more lattices 4 is also operably connected to the linkage arm 6. Movement of the linkage arm 6 along a length of the guard housing effects the pivoting of each of the one or more lattices 4 from a first position as shown in FIG. 1 to a second position (shown in FIG. 2).

The latch 10 is operably connected to a portion of the guard housing 2 and also pivotably connected to the wedge portion 8. The wedge portion 8 can include a wedge portion face 9, that is at an angle in comparison to the linkage arm 6. The latch 10 can aid in movement of the linkage arm 6 vertically upwards and down according to the directions illustrated in FIG. 1 in response to input received by the wedge portion 8. Also, latch 10 can prevent a user from manually pulling open one or more lattices 4 to stick their finger into a moving fan blade. In FIG. 1, the latch 10 also prevents movement of the linkage arm 6 unless the latch 10 is contacted by a bezel, as discussed below.

In this embodiment, six lattices 4 are shown, but in other embodiments, one, two, three, four, five, seven or more lattices 4 may be included in fan guard 1. Each of the lattices 4 can be formed of the same, or different materials from each other. These materials can be any suitable material that can maintain a structural form, such as plastics, metals, carbon based materials, and mixtures thereof.

Each of the lattices 4 includes a number of crosspieces 5, in a vertical pattern in this embodiment. In other embodiments, the crosspieces 5 can be the same, or different, and can be in any pattern that is suitable for the flow of air therethrough. In this embodiment, the pattern of crosspieces 5 remains substantially the same across each of the lattices 4. In other embodiments, the pattern of crosspieces 5 can change, such as by having a larger or smaller opening 3 or a thicker or thinner crosspiece, across each of the lattices 4.

When the lattices 4 are in the first position, as seen in FIG. 1, openings between the lattices 4 and the crosspieces 5 are smaller than or equal to the area proscribed in safety standards, such as IEC 60950, so as to not allow a person's finger to pass through the lattices 4 to contact moving fan blades.

Figure 2:
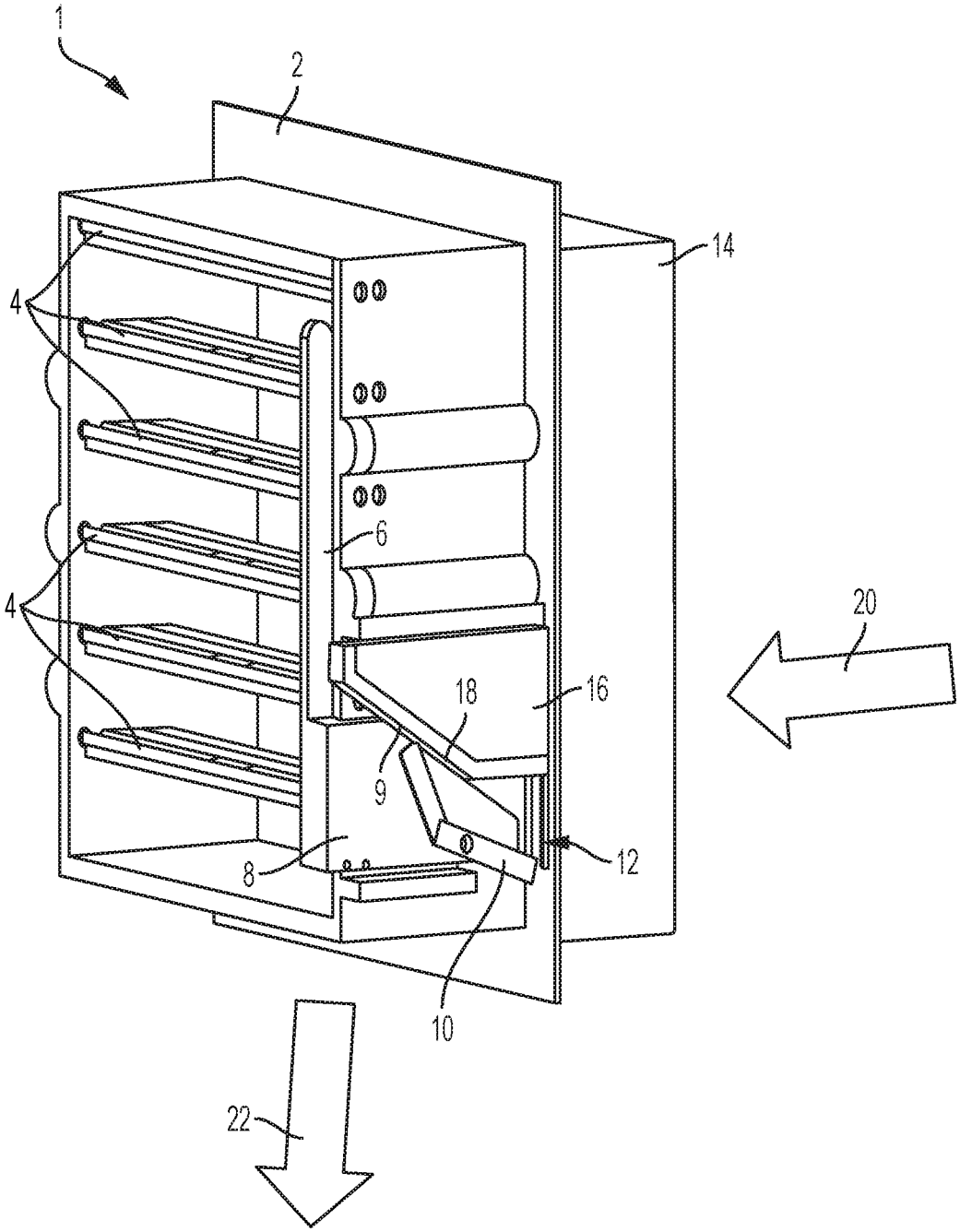
FIG. 2 is a perspective view of one embodiment of the application.

Referring to FIG. 2, there is illustrated a general, perspective view of one embodiment of the fan guard 1, with the one or more lattices 4 in a second position. In this figure a bezel 14 is shown, which includes a bezel protrusion 16. Bezel protrusion 16 is dimensioned to pass through housing opening 12. Bezel protrusion 16 includes a bezel protrusion face 18 that is configured to contact wedge portion 8 upon bezel 14 being moved in the direction of arrow 20 of FIG. 2. The bezel protrusion face 18 is at an angle that substantially opposes the angle of wedge portion face 9.

Upon movement of bezel 14 in the direction of arrow 20, the bezel protrusion face 18 contacts the wedge portion face 9 causing the wedge portion 8 to move in the direction of arrow 22. Prior to contact with the wedge protrusion face 9, the bezel protrusion face 18 contacts the latch 10, rotating latch 10 relative to the wedge portion 9 from a first latch position as shown in FIG. 1 (substantially preventing movement of the linkage arm 6) to a second latch position as shown in FIG. 2, such that the linkage arm 6 can be moved.

The movement of the wedge portion 8 in the direction of arrow 22 also moves the linkage arm 6 in the same direction. The movement of the linkage arm 6 causes rotation of each of the lattices 4 towards the bezel 14 so that each of the lattices 4 is substantially perpendicular to linkage arm 6.

When the lattices 4 are in the second position, as seen in FIG. 2, the openings between each of the lattices 4 are larger than the area proscribed in safety standards such as IEC 60950, so as to allow a larger flow of air to pass through the guard housing 2.

Figure 3:
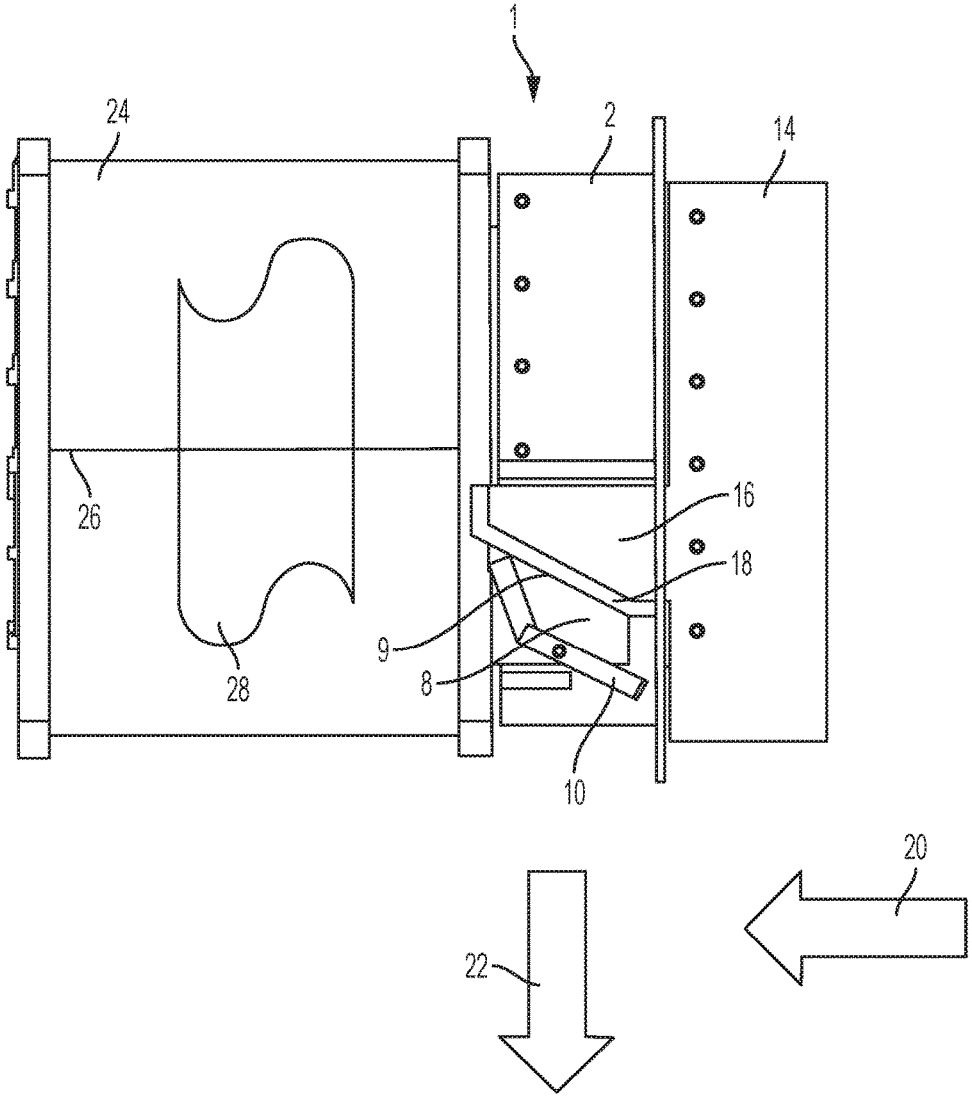
FIG. 3 is a side view of one embodiment of the application.

A side view of the configuration shown in FIG. 2 is shown in FIG. 3, along with a fan housing 24. Fan housing 24 includes a fan shaft 26 and at least one fan blade 28. In the configuration shown in FIG. 2, the lattices 4 are substantially perpendicular to linkage arm 6 so that openings between each of the lattices 4 are larger than that shown in FIG. 1. In this configuration users are not able to access the fan blade 28 with any appendage since the bezel 14 is between the user and the fan housing 24 and the bezel 14 includes a pattern of crosspieces that are smaller than or equal to the area proscribed in safety standards, such as IEC 60950, so as to not allow a person's finger to pass through bezel 14.

The fan guard 1 can be adhered and/or mechanically attached to the fan housing 24, in any suitable way using any suitable adhesive and/or hardware, so that the fan guard 1 can maintain the position of FIG. 3. Further the bezel 14 can be adhered and/or mechanically attached to the fan guard 1, in any suitable way using any suitable adhesive and/or hardware, so that bezel 14 can maintain the position of FIG. 3.

Figure 4:
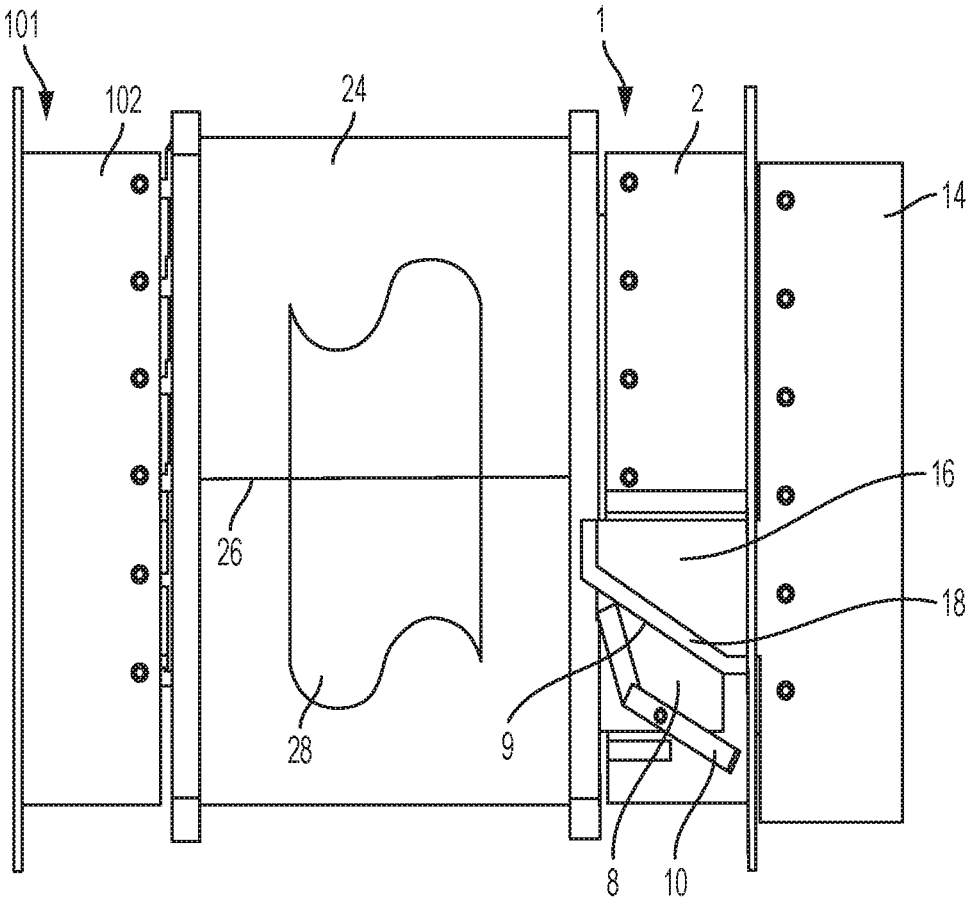
FIG. 4 is a side view of one embodiment of the application.

FIG. 3 illustrates the fan housing 24 with a fan guard 1 and a bezel 14 on one face of the fan housing 24 (either an inlet or an outlet of fan housing 24). But, in other embodiments the fan housing 24 can include a second fan guard 101 on a face opposite to fan guard 1, as shown in FIG. 4. In FIG. 4 the second fan guard 101 is substantially a mirror image of fan guard 1, with the second fan guard 101 including a second guard housing 102, one or more lattices (not shown), a linkage arm (not shown), a wedge portion (not shown) operably connected to the linkage arm and a latch (not shown).

Figure 5:
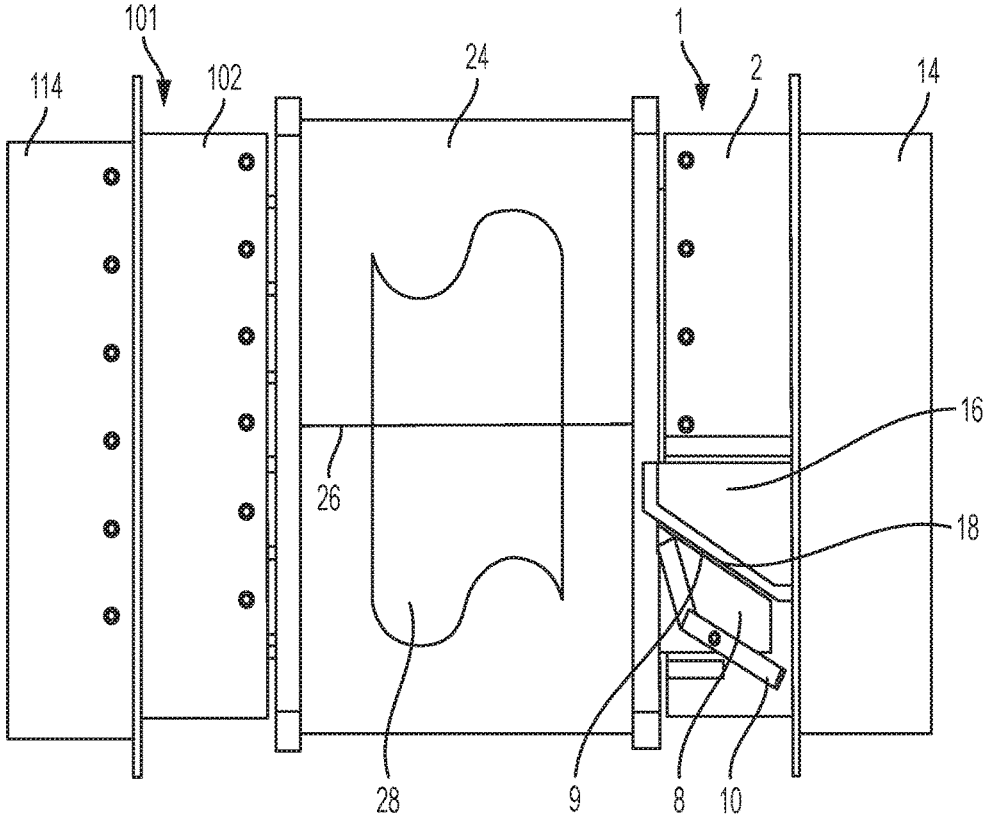
FIG. 5 is a side view of one embodiment of the application.

In other embodiments, along with the second fan guard 101, a recirculation flap structure 114 can be included to interact with and contact the second fan guard 101, as shown in FIG. 5. The recirculation flap structure 114 can be built into a larger product (e.g., server in FIGS. 10 and 11). The recirculation flap structure 114 can contain a wedge structure (not shown) to open the lattices of fan guard 101. Recirculation flap structure 114 can be included so that if a fan is pulled out of the larger product and the fan blades are still spinning due to momentum, a user cannot stick their finger into the moving fan blades on the back side of the fan structure. The recirculation flap structure 114 could also be combined with the second fan guard 101 before being put into a separate product.

The second fan guard 101 can be adhered and/or mechanically attached to the fan housing 24, in any suitable way using any suitable adhesive and/or hardware, so that the second fan guard 101 can maintain the position of FIG. 5. When the recirculation flap structure 114 is combined with the fan guard 101, the recirculation flap structure 114 can be adhered and/or mechanically attached to the second fan guard 101, in any suitable way using any suitable adhesive and/or hardware, so that the recirculation flap structure 114 can maintain the position of FIG. 5.

Figure 6:
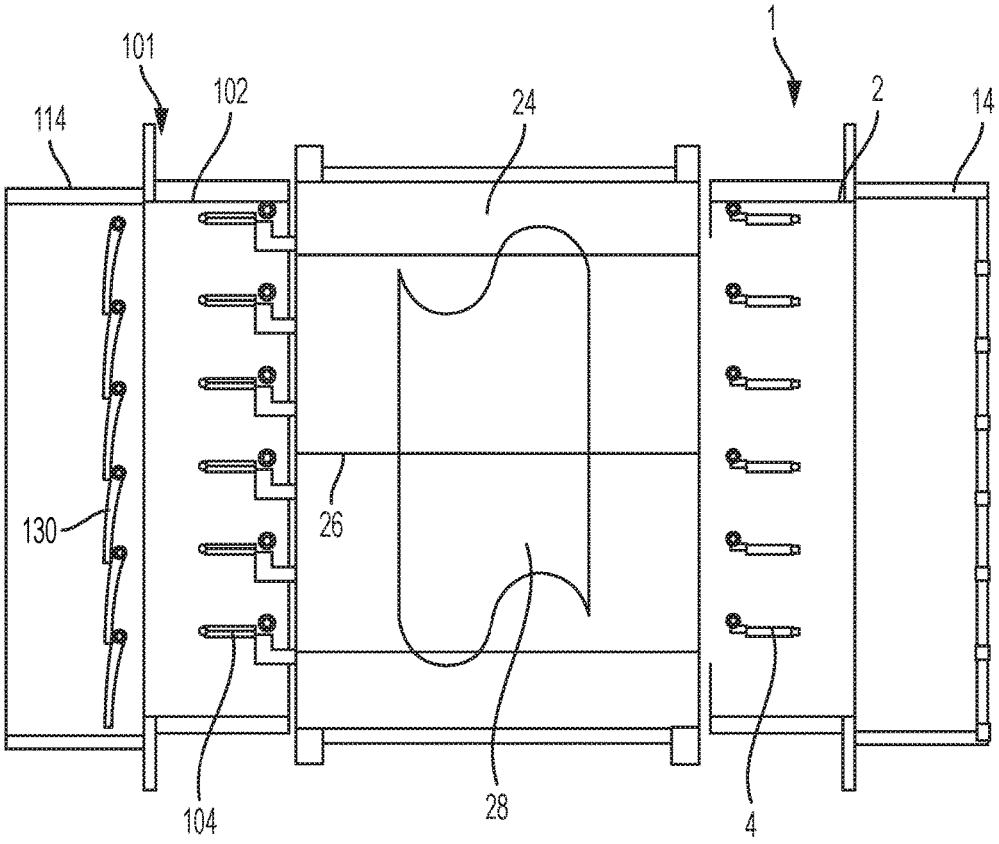
FIG. 6 is a side view of one embodiment of the application.

FIG. 6 is a cross-sectional view of FIG. 5, so that the interior of the guard housing 2, second guard housing 102, bezel 14 and recirculation flap structure 114 can be seen. In the fan guard 1 lattices 4 are rotated into the second position (as more clearly seen in FIG. 2) since bezel 14 has moved into contact with guard housing 2. In the second fan guard 101 second lattices 104 are also rotated into a second lattice, second position (similar to that seen in FIG. 2 of lattices 4). The rotation of second lattices 104 is due to a wedge portion (not shown) of the second housing 102 being contacted by a protrusion (not shown) of the recirculation flap structure 114.

In the embodiment shown in FIG. 6, the recirculation flap structure 114 includes a plurality of flaps 130. In this embodiment six flaps 130 are shown, but, in other embodiments, one, two, three, four, five, seven or more flaps 130 may be included within recirculation flap structure 114. Each of the flaps 130 can be formed of the same, or different materials from each other. These materials can be any suitable material that can maintain a structural form, such as plastics, metals, carbon based materials, and mixtures thereof.

Each of the flaps 130 are rotationally attached to the recirculation flap structure 114 and are configured to rotate from the position shown in FIG. 6, to the position in FIG. 7, described more fully below, upon introduction of air pressure. In FIG. 6, the fan 28 is not rotating and is not creating positive or negative air pressure at the flaps 130. Flaps 130 act to block air from recirculating through the fan in the event of a non-operation or failed fan.

Figure 7:
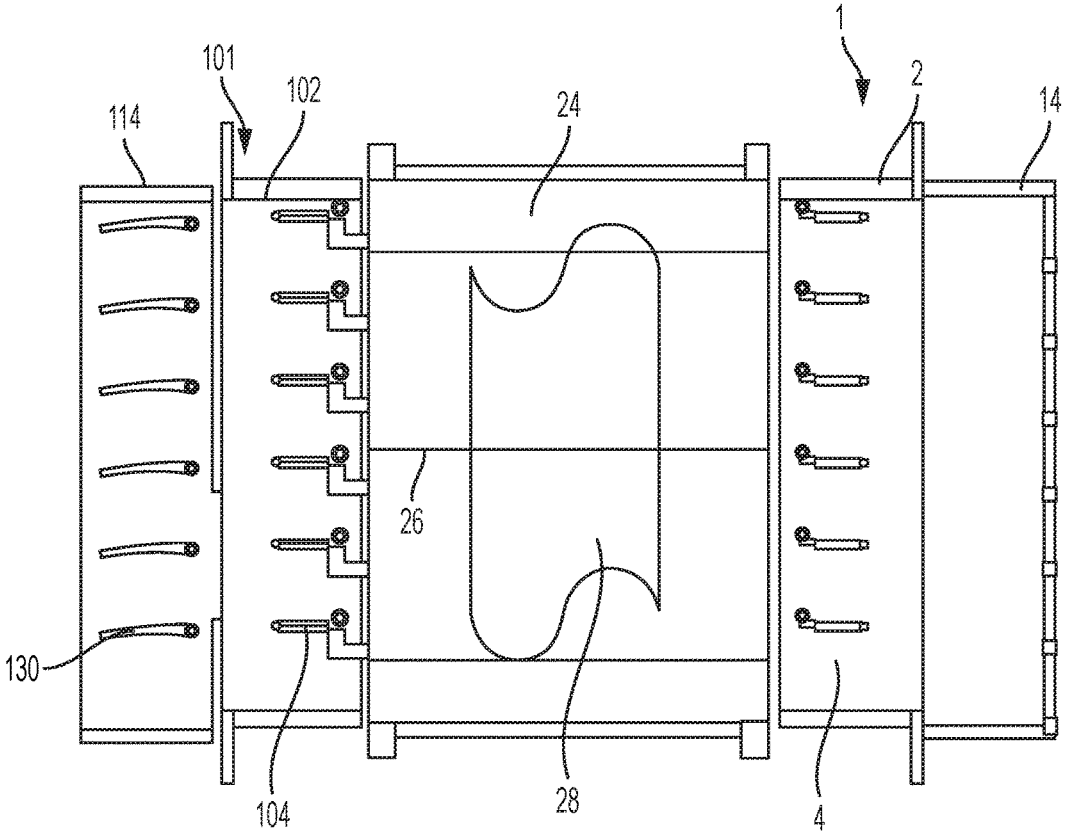
FIG. 7 is a side view of one embodiment of the application.
Figure 10:
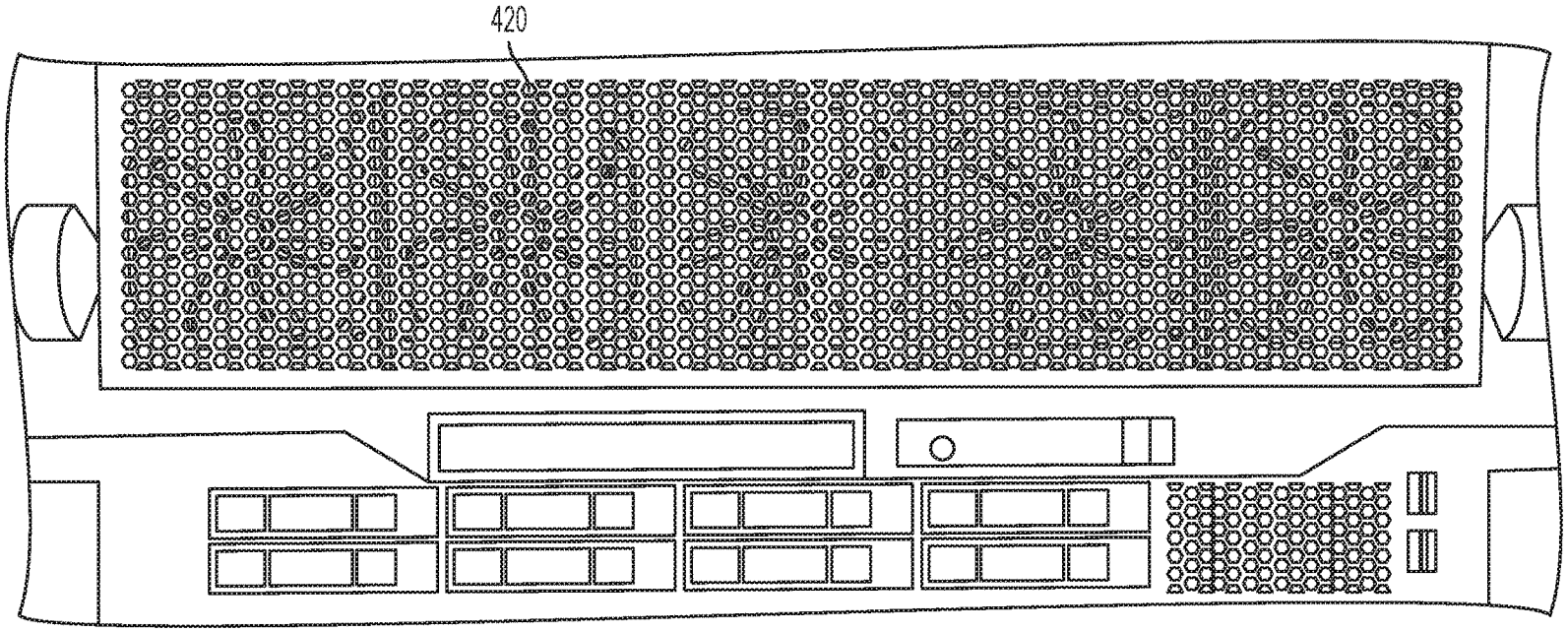
FIG. 10 is a front view of a product containing multiple fan assemblies that sit behind a bezel that can be used in conjunction with the fan guards of the present disclosure.
Figure 11:
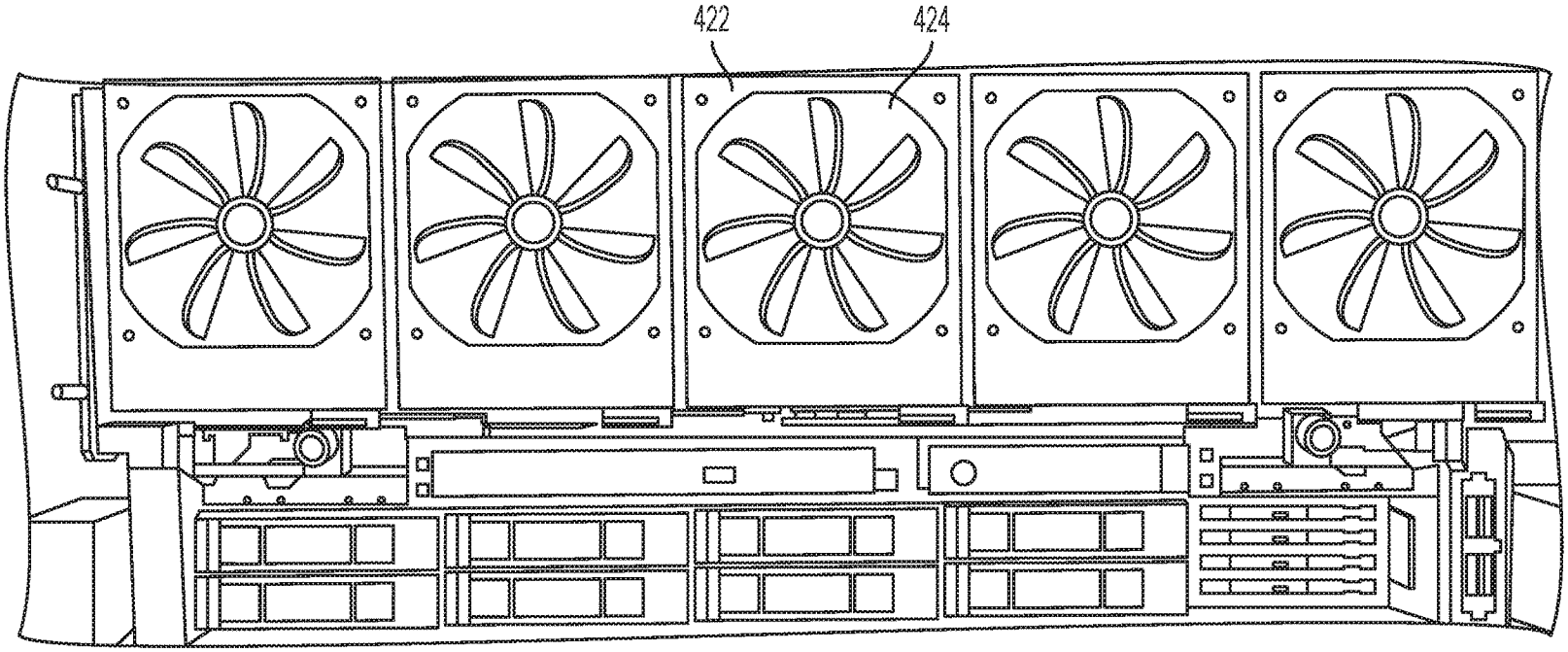
FIG. 11 is a front view of a product containing multiple fan assemblies with a removed bezel that can be used in conjunction with the fan guards of the present disclosure.

In FIG. 7, the fan 28 is rotating and is creating an air pressure differential between the front and rear of the fan such that the flaps 130 are caused to rotate and allow air from the fan 28 to pass therethrough. Upon the fan 28 stopping rotation and stopping the creation of an air pressure, flaps 130 are configured to rotate back to the position shown in FIG. 6. Although fan 28 is shown separately in FIG. 7, to receive power the fan 28 would receive external electricity, such as when the fan 28 is operably connected to a server (as shown in FIGS. 10 and 11).

Figure 8A:
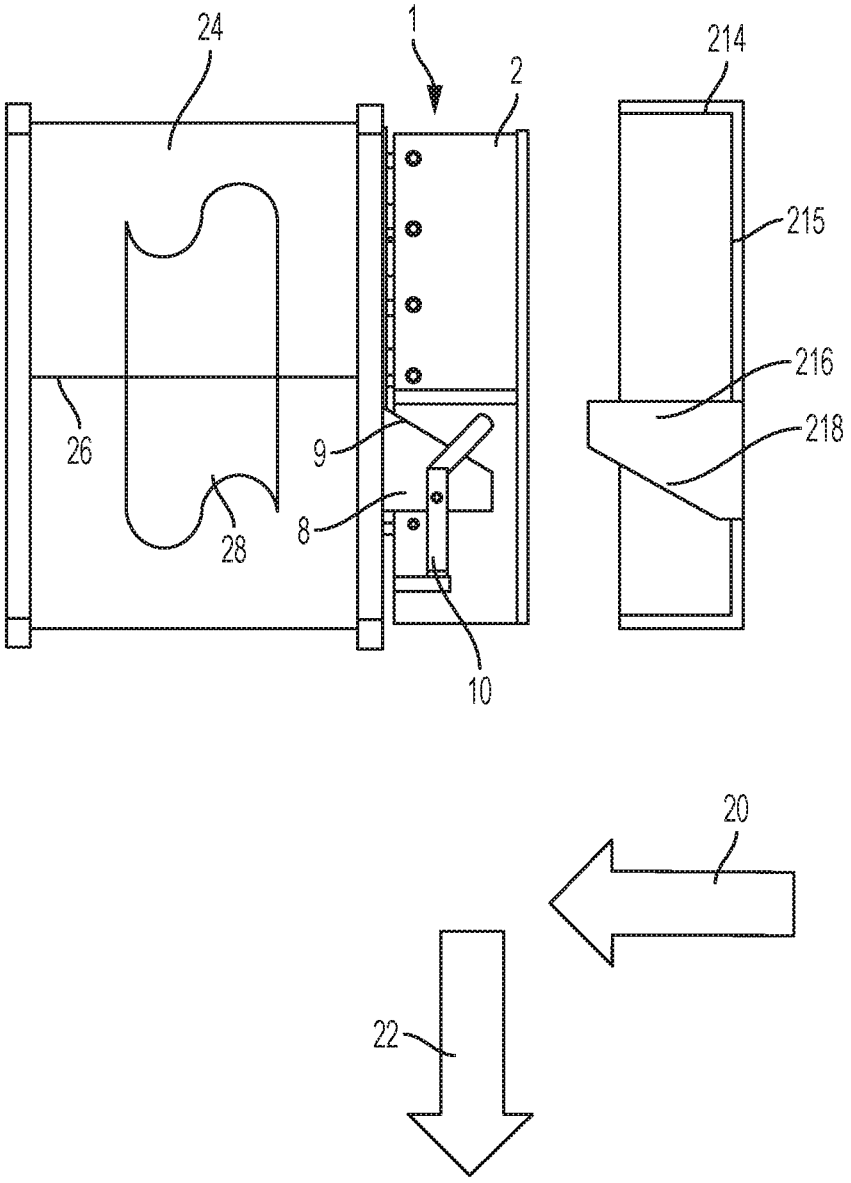
FIG. 8A is a side view of one embodiment of the application.

Another embodiment of the present disclosure is shown in FIG. 8A. In this embodiment, an alternate bezel 214 can be used in conjunction with fan guard 1. In this embodiment, the alternate bezel protrusion 216 extends from a front face 215 of the alternate bezel 214. The alternate bezel protrusion 216 includes an alternate bezel protrusion face 218 that is configured to contact wedge portion 8 upon alternate bezel 214 being moved in the direction of arrow 20 of FIG. 8A. The alternate bezel protrusion face 218 is at an angle that substantially opposes the angle of wedge portion face 9. In the configuration shown in FIG. 8A the lattices (4 of FIG. 1) are in the first position.

Figure 8B:
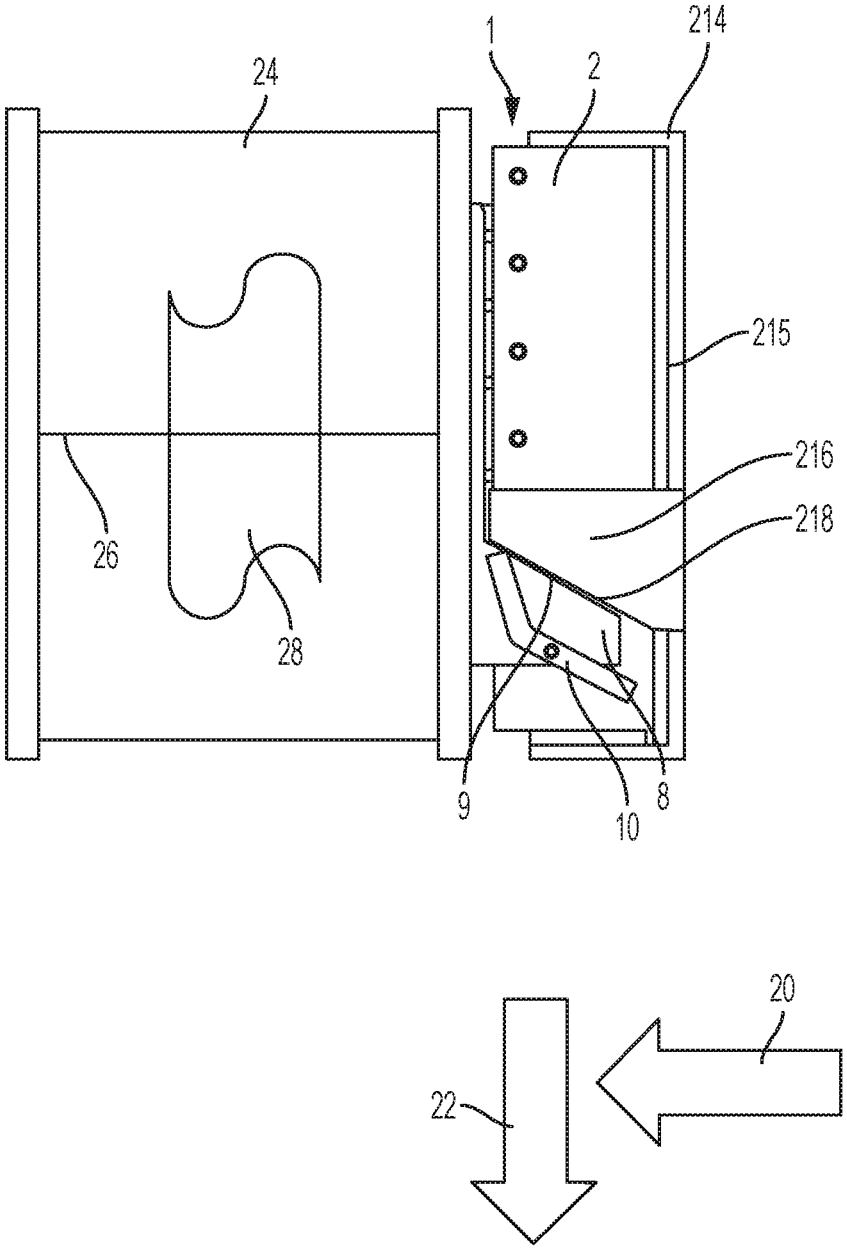
FIG. 8B is a side view of one embodiment of the application.

Upon movement of alternate bezel 214 in the direction of arrow 20, the alternate bezel protrusion face 218 contacts the wedge portion face 9 causing the wedge portion 8 to move in a transverse direction shown by arrow 22 to the position shown in FIG. 8B (substantially the same configuration as that shown in FIG. 2).

In FIG. 8B the wedge portion 8 has moved in the direction of arrow 22, also moving the linkage arm (6 of FIG. 2) in the same direction. The movement of the linkage arm causes rotation of each of the lattices (4 of FIG. 2) towards the alternate bezel 214 so that each of the lattices is substantially perpendicular to linkage arm. The alternate bezel 214 can be adhered and/or mechanically attached to the fan guard 1, in any suitable way using any suitable adhesive and/or hardware, so that alternate bezel 214 can maintain the position shown in FIG. 8B. In the configuration shown in FIG. 8B the lattices (4 of FIG. 1) are in the second position.

As can be seen from FIG. 8B, this embodiment reduces the overall length of the structure as compared to the overall length of the structure of FIG. 3 due to a portion of the guard housing 2 extending into a portion of alternate bezel 214.

Figure 9A:
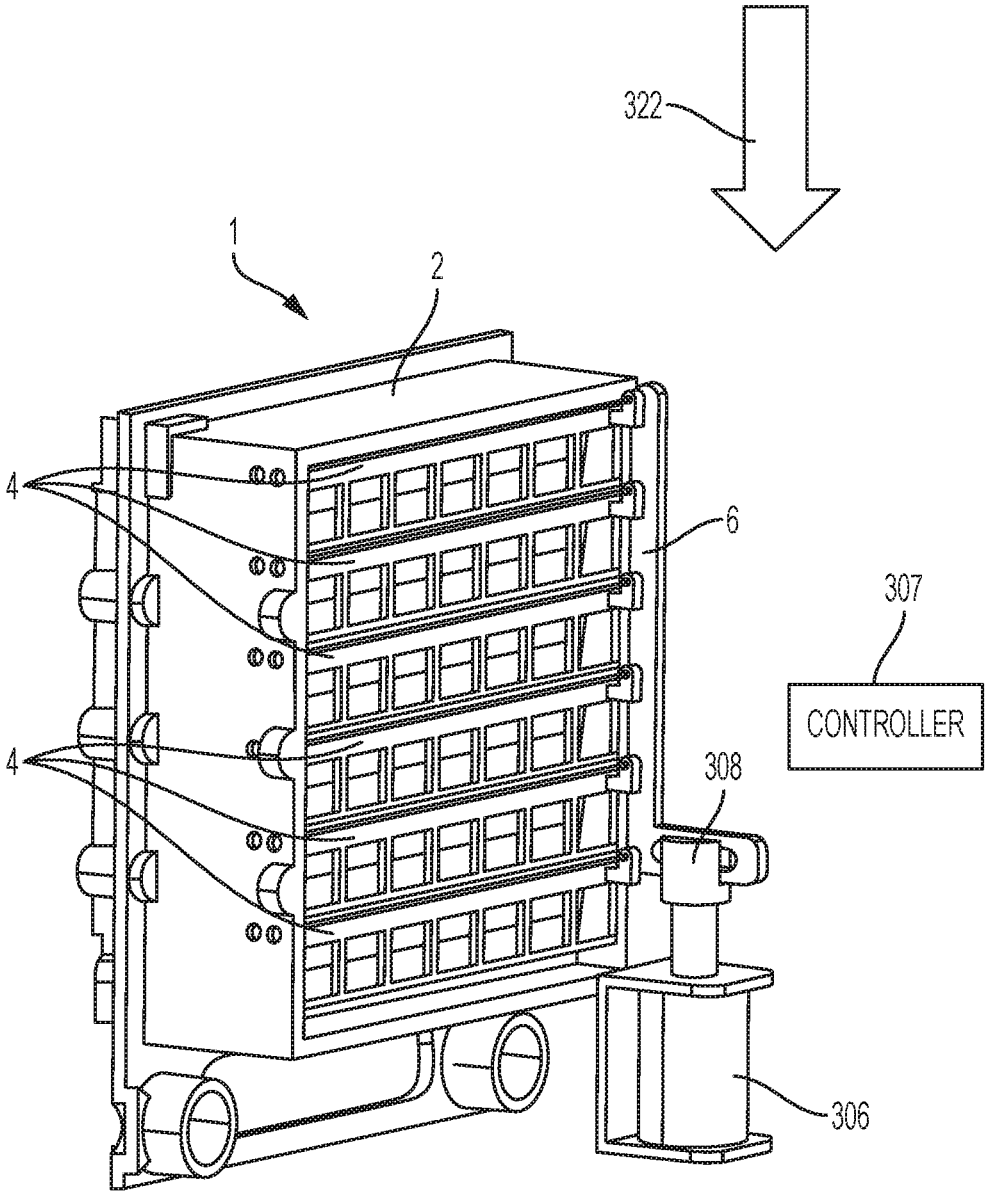
FIG. 9A is a perspective view of one embodiment of the application.

Another embodiment of the present disclosure is shown in FIG. 9A. In this embodiment movement of the lattices 4 is effected by a solenoid 306. The solenoid 306 is shown as a representative box with a protrusion 308, but in other embodiments, any other solenoid or actuator that is capable of moving a lattice can be used. The protrusion 308 can be actuated to extend and retract by the solenoid 306 and is operably attached the linkage arm 6 to move the linkage arm 6 in the direction of arrow 322. This solenoid 306 is configured to retract the protrusion 308, but in other embodiments, solenoid 306 can be located in a different location and can extend the protrusion 308 to effect movement of the linkage arm 6.

Also included in this embodiment is a controller 307 that can be connected to the solenoid 306 wirelessly (as shown) or through a wired connection. The controller 307 is configured to send an electronic signal to the solenoid 306 to extend and retract protrusion 308. As used herein, the term "controller" can be any type of controller or processor, and may be embodied as one or more controllers, configured, designed, programmed, or otherwise adapted to perform the functionality discussed herein. As the term controller or processor is used herein, a controller or processor may include use of a single integrated circuit ("IC"), or may include use of a plurality of integrated circuits or other components connected, arranged, or grouped together, such as controllers, microprocessors, digital signal processors ("DSPs"), parallel processors, multiple core processors, custom ICs, application specific integrated circuits ("ASICs"), field programmable gate arrays ("FPGAs"), adaptive computing ICs, associated memory (such as RAM, DRAM and ROM), and other ICs and components. As a consequence, as used herein, the term controller (or processor) should be understood to equivalently mean and include a single IC, or arrangement of custom ICs, ASICs, processors, microprocessors, controllers, FPGAs, adaptive computing ICs, or some other grouping of integrated circuits which perform the functions discussed below, with associated memory, such as microprocessor memory or additional RAM, DRAM, SDRAM, SRAM, MRAM, ROM, FLASH, EPROM or EEPROM. A controller (or processor) (such as controller 307), with its associated memory, may be adapted or configured (via programming, FPGA interconnection, or hard-wiring) to various extensions and retractions. Although controller 307 is arranged in a single housing, it is contemplated that various components of the controller 307 could have separate housings.

Figure 9B:
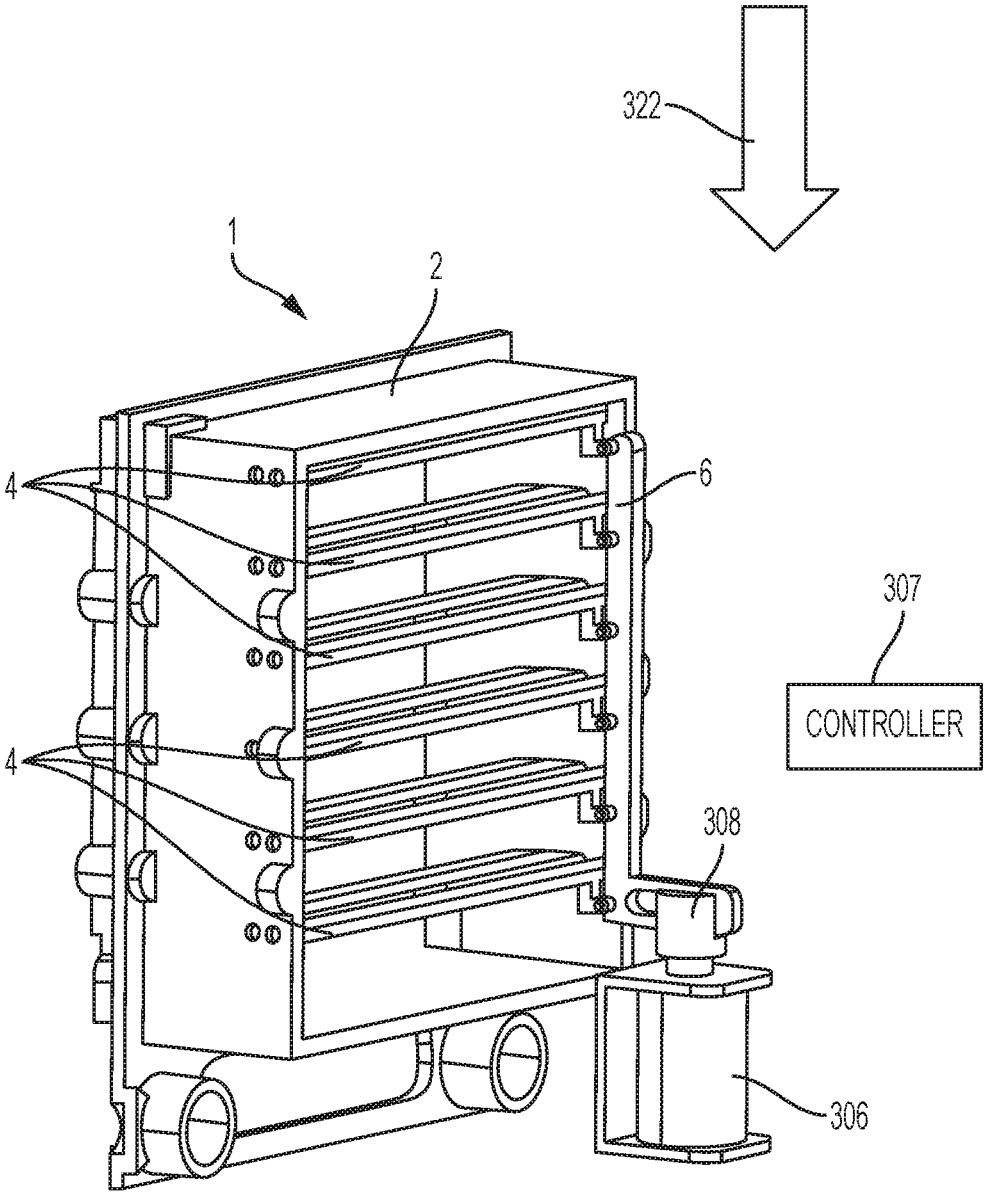
FIG. 9B is a perspective view of one embodiment of the application.

Transitioning from the first lattice position of FIG. 9A to the second lattice position of FIG. 9B the solenoid 306 retracts protrusion 308 in the direction of arrow 322. As can be seen in FIG. 9B the retraction of protrusion 308 causes lattices 4 to rotate into the second lattice position. The protrusion 308 could then again extend to rotate the lattices 4 into the first lattice position (FIG. 9A). The protrusion 308 could be prompted to extend the protrusion based on input from (a) a switch being changed to an off position, such as by removal of an external cover, opening of a door, or removal of a bezel and/or (b) a sensor, which determines if an external cover is removed, a door has been opened, or a bezel has been removed. A switch 318 is shown in FIG. 9C, discussed below.

In FIG. 9B, the controller 307 can receive a signal from a switch or sensor to detect whether or not the fan shaft 26 and/or the fan blade 28 are accessible by a user. If the fan shaft 26 and/or the fan blade 28 are accessible by a user, the controller 307 can ensure that protrusion 308 is extended so that lattices 4 are in the first position. If fan shaft 26 and/or the fan blade 28 are not accessible by a user, the controller 307 can ensure that protrusion 308 is retracted such that lattices 4 are in the second position.

Figure 9C:
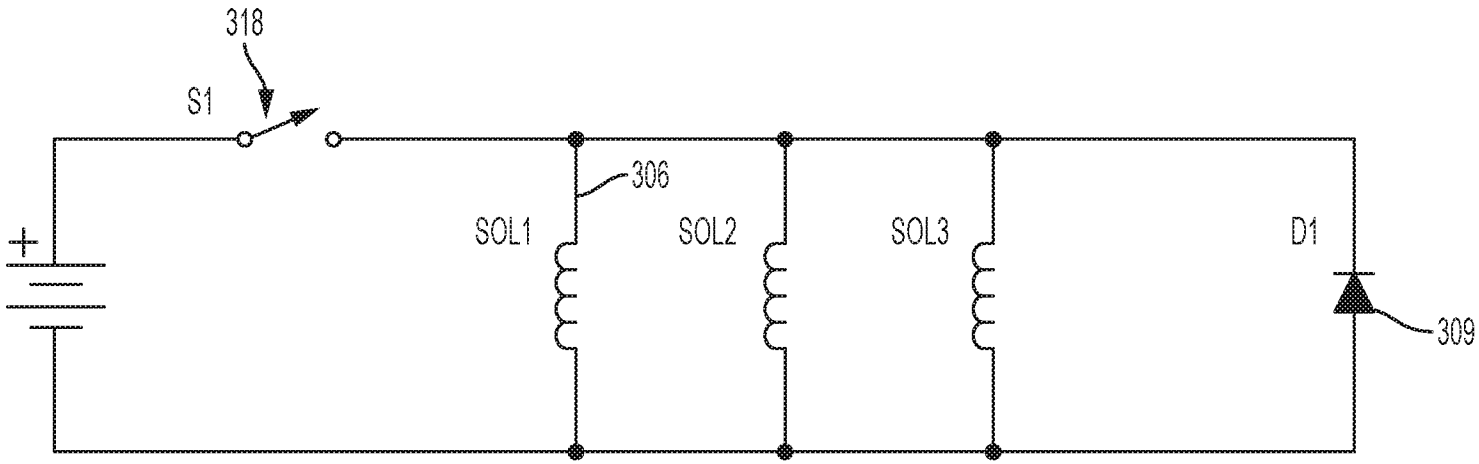
FIG. 9C is a circuit diagram of one embodiment of the application.

FIG. 9C illustrates one embodiment of a circuit diagram of the present disclosure. As can be seen the switch 318 of the circuit can be configured to not only control solenoid 306 (SOL1) but one, two or more additional solenoids (SOL2, SOL3). The controlled solenoids (SOL1, SOL2, SOL3) can be wired as shown in FIG. 9C in parallel so that if any of the solenoids fail, other solenoids can remain operational. Optionally, and as shown in FIG. 9C, a flyback diode 309 can be included in the circuit. Flyback diode 309 can substantially reduce or eliminate flyback, which is a sudden voltage spike seen across an inductive load when a supply current is suddenly reduced or interrupted.

The switch 318 can be activated and deactivated by removal and replacement of, in this embodiment, a bezel, but in other embodiments any suitable cover or door. In other embodiments, a suitable sensor, such as an optical sensor, light sensor and/or a pressure sensor can replace switch 318 to detect removal of the bezel, or suitable cover or door.

The methods and devices of the present disclosure will be better understood by reference to the following examples, which are provided as exemplary of the disclosure and not by way of limitation.

EXAMPLE 1

When fan guard 1 is in the first position, as shown in FIG. 1, square areas 3 formed by the areas between crosspieces 5 are about 7 mm per side. Therefore, the open area between the crosspieces 5 of each of the lattices 4 is about 441 $mm^2$.

When fan guard 1 is in the second position, as shown in FIG. 2, the openings formed by the rotation of each of the lattices 4 forms an open area between each of the lattices 4 and the edge of the guard housing 2 of about 639 $mm^2$.

To determine the difference in pressure drop between the two lattice positions, the following formulas were used:

$$\Delta p = \frac{k\rho}{2} v^2$$

Wherein p is pressure, k is the minor loss coefficient, ρ is the air density and ν is air velocity. k Next, the following equations were solved to determine the difference in pressure drop of air passing through the open area shown in FIG. 2 ($A_1$) as compared to the air passing through the open area shown in FIG. 1 ($A_2$).

$$v = \frac{\dot{V}}{A} \Delta p = \frac{k\rho}{2}\left(\frac{\dot{V}}{A}\right)^2$$

$$\frac{\Delta p_1}{\Delta p_2} = \frac{A_2^2}{A_1^2}$$

$$\frac{\Delta p_1}{\Delta p_2} = \frac{(441\ mm^2)^2}{(639\ mm^2)^2} = 0.476$$

Wherein $\dot{V}$ is constant volume flow and A is area.

As can be seen, the pressure drop of air passing through the open area shown in FIG. 2 ($A_1$) as compared to the air passing through the open area shown in FIG. 1 ($A_2$) is about 47.6%. This pressure drop is indicative of an increased airflow when the lattices 4 are rotated by linkage arm 6. Due to an increased air flow, fan speeds can be decreased to achieve a similar air flow to the flow when the lattices 4 are in the second lattice position. This reduction in fan speed can reduce overall noise of a fan, reduce energy consumption of the fan, and prolong the life of the fan.

EXAMPLE 2

A front view of five individual fan assemblies, which can be used in conjunction with the fan guards described above, is shown in FIG. 10. In FIG. 10, a bezel 420 (honeycomb structure) is shown as covering five fan assemblies and separates the fan blades of each fan assembly from where the user can access the covered fan blades. With the bezel 420 installed, the fan guard would be in the state shown in FIG. 2. Upon removal of the bezel 420, the fan guard would be placed in the state shown in FIG. 1.

A front view of the five individual fan assemblies of FIG. 10 are shown again in FIG. 11, with the bezel 420 removed. In this view each fan assembly includes a barrier 422, which is between where the user can access and the fan blades 424.

In embodiments of the present disclosure, each of these barriers 422 (the barriers of which are indicated by the five rectangular boxes) can be removed and replaced with the fan guard 1 described above.

The barrier 422 shown in FIG. 11 has an external area of about 85 mm×85 mm, with an about 54% open area. In the present disclosure, as shown in FIG. 2, the fan guard 1 can have an open area of about 77% when the front bezel is installed.

While the present application has been particularly shown and described with respect to preferred embodiments thereof, it will be understood by those skilled in the art that the foregoing and other changes in forms and details may be made without departing from the spirit and scope of the present application. It is therefore intended that the present application not be limited to the exact forms and details described and illustrated, but fall within the scope of the appended claims.

What is claimed is:

1. A fan guard comprising:

a guard housing, the guard housing comprising:

a housing opening;

one or more lattices, wherein the one or more lattices are pivotably connected to a portion of the guard housing;

a linkage arm, wherein the one or more lattices are operably connected to the linkage arm; and a wedge portion operably connected to the linkage arm, wherein the wedge portion comprises a wedge portion face for cooperative engagement with a portion of the linkage arm, and wherein the linkage arm is configured to move along a length of the guard housing and the linkage arm is configured to pivot the one or more lattices from a first position to a second position.

2. The fan guard of claim 1, further comprising a latch that is operably connected to a portion of the guard housing and pivotably connected to the wedge portion.

3. The fan guard of claim 1, wherein each of the one or more lattices comprises crosspieces spanning at least a portion of each of the one or more lattices.

4. The fan guard of claim 3, wherein in the first position, openings between the crosspieces are smaller than or equal to the area proscribed in IEC 60950.

5. The fan guard of claim 3, wherein in the second position, openings between the crosspieces are larger than the area proscribed in IEC 60950.

6. The fan guard of claim 1, further comprising a bezel, wherein the bezel comprises a bezel protrusion and a bezel protrusion face.

7. The fan guard of claim 6, wherein the bezel protrusion is configured to extend through the housing opening and contact the latch and wedge portion of the guard housing.

8. The fan guard of claim 7, wherein the bezel protrusion face is configured to contact the wedge portion face at an angle.

9. The fan guard of claim 8, wherein the bezel protrusion is configured to move in a first direction and the bezel protrusion face is configured to move the linkage arm in a direction substantially perpendicular to the first direction.

10. The fan guard of claim 1, further comprising a recirculation flap structure that is configured to contact the fan assembly, wherein the recirculation flap structure comprises a plurality of flaps that are rotationally attached to the recirculation flap structure and are configured to rotate from a first flap position to a second flap position in response to a change in air pressure.

11. The fan guard of claim 1, further comprising a solenoid, wherein the solenoid is configured to move the linkage arm in a direction along a length of the guard housing.

12. The fan guard of claim 11, further comprising a switch, the switch electrically connected to the solenoid.

13. The fan guard of claim 12, further comprising one or more additional solenoids electrically connected to the switch.

14. A method of operating a fan guard, the method comprising:

moving a bezel, wherein the bezel comprises a bezel protrusion and a bezel protrusion face in a first direction towards a guard housing, the guard housing comprising:

a housing opening;

one or more lattices, wherein the one or more lattices are pivotably connected to a portion of the guard housing;

a linkage arm, wherein the one or more lattices are operably connected to the linkage arm;

a wedge portion operably connected to the linkage arm, wherein the wedge portion comprises a wedge portion face, and wherein the linkage arm is configured to move along a length of the guard housing and the linkage arm is configured to pivot the one or more lattices from a first position to a second position, wherein the bezel protrusion extends through the housing opening;

contacting the latch to rotate the latch from a first latch position to a second latch position;

contacting the wedge portion face with the bezel protrusion face, wherein the contact of the wedge portion face moves the linkage arm in a second direction, the second direction substantially perpendicular to the first direction; and rotating the one or more lattices from a first position to a second position.

15. The method of claim 14, further comprising the steps of moving the bezel in a third direction that is substantially opposite the first direction, withdrawing the bezel protrusion from the housing opening;

moving the linkage arm in a fourth direction, the fourth direction substantially opposite the third direction;

rotating the one or more lattices from the second position to the first position; and rotating the latch from the second latch position to the first latch position.

* * * * *